US012071268B2

(12) United States Patent
Pape

(10) Patent No.: US 12,071,268 B2
(45) Date of Patent: Aug. 27, 2024

(54) BAG WEB AND METHOD AND EQUIPMENT FOR PACKING ITEMS

(71) Applicant: SCHUR TECHNOLOGY A/S, Horsens (DK)

(72) Inventor: Henrik Pape, Horsens (DK)

(73) Assignee: SCHUR TECHNOLOGY A/S, Horsens (DK)

( * ) Notice: Subject to any disclaimer, the term of this patent is extended or adjusted under 35 U.S.C. 154(b) by 28 days.

(21) Appl. No.: 16/496,463

(22) PCT Filed: Mar. 27, 2018

(86) PCT No.: PCT/DK2018/050056
§ 371 (c)(1),
(2) Date: Sep. 23, 2019

(87) PCT Pub. No.: WO2018/177490
PCT Pub. Date: Oct. 4, 2018

(65) Prior Publication Data

US 2020/0369416 A1 Nov. 26, 2020

(30) Foreign Application Priority Data

Mar. 27, 2017 (DK) ..... PA 2017 70218

(51) Int. Cl.
*B65B 43/12* (2006.01)
*B65B 7/02* (2006.01)
(Continued)

(52) U.S. Cl.
CPC ..... *B65B 43/123* (2013.01); *B65B 7/02* (2013.01); *B65B 43/267* (2013.01); *B65B 61/06* (2013.01); *B65D 75/42* (2013.01); *B65D 31/10* (2013.01)

(58) Field of Classification Search
CPC .... B65B 1/02; B65B 3/02; B65B 7/02; B65B 43/123; B65B 43/267; B65B 61/188;
(Continued)

(56) References Cited

U.S. PATENT DOCUMENTS 4,630,311 A 12/1986 Bentson
4,654,878 A 3/1987 Lems
(Continued)

FOREIGN PATENT DOCUMENTS

CN 106458372 A 2/2017
DE 102015200783 A1 7/2016
(Continued)

OTHER PUBLICATIONS

Supplementary European Search Report dated Dec. 9, 2020 for Application No. 18 77 5127.
(Continued)

*Primary Examiner* — Anne Marie Antonucci
*Assistant Examiner* — Luis G Del Valle
(74) *Attorney, Agent, or Firm* — Schmeiser, Olsen & Watts, LLP

(57) ABSTRACT

A bag web, equipment and method for packing items, liquid or bulk goods in film bags, which are conveyed in a continuous bag web of bag items through a filling station is provided. The mouths of the bags are held open for receiving items, after which the bags are closed and are separated from the web. The bag web includes a zip closure, which is applied parallel to the upper edge of the bag web and is continuous for the entire length of the bag web. The zip closure is coupled to the first guide, which is arranged to retain and guide the bag web in the zip closure along a first section of a transport path through the equipment.

9 Claims, 12 Drawing Sheets

(51) Int. Cl.

| | |
|---|---|
| ***B65B 43/26*** | (2006.01) |
| ***B65B 61/06*** | (2006.01) |
| ***B65D 30/20*** | (2006.01) |
| ***B65D 75/42*** | (2006.01) |

(58) Field of Classification Search
CPC ..... B65B 61/06; B65B 61/007; B65B 9/08; B65D 75/42; B65D 31/10
See application file for complete search history.

(56) References Cited

U.S. PATENT DOCUMENTS

| | | | | |
|---|---|---|---|---|
| 4,665,552 | A * | 5/1987 | Lems | B65B 43/123 53/469 |
| 4,832,505 | A | 5/1989 | Ausnit et al. | |
| 4,850,178 | A | 7/1989 | Ausnit | |
| 4,945,714 | A | 8/1990 | Bodolay et al. | |
| 5,157,811 | A * | 10/1992 | Bodolay | B65B 9/093 24/585.12 |
| 5,519,982 | A * | 5/1996 | Herber | B65D 33/2541 53/139.2 |
| 5,704,192 | A | 1/1998 | Jostler et al. | |
| 5,733,045 | A | 3/1998 | Jostler et al. | |
| 6,272,815 | B1 * | 8/2001 | Todd | B29C 66/0342 53/64 |
| 6,871,473 | B1 * | 3/2005 | Dutt | B65B 9/093 53/139.2 |
| 6,931,824 | B2 * | 8/2005 | Rogers | B65B 3/32 53/389.1 |
| 8,707,663 | B2 * | 4/2014 | Matheyka | B65B 59/04 141/86 |
| 2003/0180486 | A1 * | 9/2003 | Pape | B65B 43/465 428/34.1 |
| 2004/0134166 | A1 * | 7/2004 | Ausnit | B65B 9/093 53/412 |
| 2005/0132670 | A1 * | 6/2005 | Curran | B65B 9/08 53/469 |
| 2009/0320958 | A1 * | 12/2009 | Matheyka | B65B 25/005 141/98 |
| 2013/0067860 | A1 * | 3/2013 | McDonald | B65B 51/146 53/405 |
| 2014/0130461 | A1 * | 5/2014 | Johan | B65B 43/123 53/284.7 |
| 2017/0137155 | A1 * | 5/2017 | Pape | B65B 1/04 |

FOREIGN PATENT DOCUMENTS

| | | | |
|---|---|---|---|
| EP | 0249868 | A2 | 12/1987 |
| EP | 1087890 | A1 | 4/2001 |
| EP | 1 379 436 | A1 | 1/2004 |
| EP | 1379436 | A1 | 1/2004 |
| EP | 1 502 869 | A2 | 2/2005 |
| EP | 1502869 | A2 | 2/2005 |
| EP | 1379436 | B1 | 4/2005 |
| EP | 2492207 | A1 | 8/2012 |
| RU | 42504 | U1 | 12/2004 |
| RU | 2516477 | C2 | 5/2014 |
| WO | 9425365 | A1 | 11/1994 |
| WO | WO9425365 | A1 | 11/1994 |
| WO | 02083506 | A1 | 10/2002 |

OTHER PUBLICATIONS

International Search Report issued Jun. 6, 2018 for PCT/DK2018/050056.
Written Opinion issued Jun. 6, 2018 for PCT/DK2018/050056.
Russian Office Action dated Jun. 29, 2021 for Application No. PA 2017 70218.
Indian Office Action dated Aug. 16, 2021 for Application No. 201917040068.

* cited by examiner

BAG WEB AND METHOD AND EQUIPMENT FOR PACKING ITEMS

CROSS-REFERENCE TO RELATED APPLICATIONS

This application claims priority to PCT Application No. PCT/DK2018/050056, having a filing date of Mar. 27, 2018, which is based on DK Application No. PA 2017 70218, having a filing date of Mar. 27, 2017, the entire contents both of which are hereby incorporated by reference.

FIELD OF TECHNOLOGY

The following relates to a bag web for packing items, such as liquids, or bulk goods, the bag web comprising a continuous row of bag items, which are separated by a number of slits, extending from a bottom edge of the web up to just below a top edge of the bag web, the lateral edges of the bag items being closed with welds at the slits, and the bag web comprising an upper peripheral zone above a zip closure.

The following also relates to a method for packing items, such as liquids, or bulk goods in bag items, which are conveyed in a continuous bag web of bag items through equipment with a filling station, in which the mouths of the bags are held open for receiving items, after which the bags are closed and are separated from the web.

The following also relates to equipment for packing items, such as liquids, or bulk goods in bags, which are conveyed in a continuous web of bag items through a filling station, wherein the mouths of the bags are held open for receiving items, the bags then being closed and separated from the web, and where the equipment comprises:

a filling station, where the bag openings are held open for receiving items, guiding means or guide, which are arranged to retain and guide the bag web along a transport path through the equipment, wherein the guiding means or guide, in connection with this passage, force the edges of the bag mouth apart for successive opening of the bags in the filling station and then, after the bags have been filled, bringing the edges of the bag mouths back together for closing the bags.

BACKGROUND

Nowadays many packing bags are made with zip closures, so that the user can close the bag again, if he or she is not using the entire contents of the bag immediately.

There has also been a desire for many years to be able to increase the filling speed and to be able to manufacture packing bags more cheaply.

An example of quick and effective filling of packing bags is described for example in EP 1,087,890 B1. In this, a bag web with bag items is conveyed through equipment with a filling station for filling goods, e.g. liquids or bulk goods, in bag items. The bag web comprises a continuous row of bag items, which are separated by a number of slits, extending from a bottom edge of the web up to just below a top edge of the bag web. The lateral edges of the bag items are closed with welds at the slits, and the upper peripheral zone comprises perforations, which are arranged to grip around pins on the guiding means or guide of the filling equipment. After completion of sealing of the bag opening, the edge zone with the perforations is cut off, and the sealed bag items are cut from the bag web. In the filling station, the bag items are opened by increasing the distance between the two guiding means or guides with pins.

This technology is reasonably quick and effective to use for filling bag items, but there is considerable wastage of material, in the form of the trimmed edge zones.

U.S. Pat. No. 4,665,552 A describes a bag web with a continuous row of bag items, which are separated by a number of slits, extending from a bottom edge of the web up to just below a top edge of the bag. Moreover, equipment is also described for packing items in the form of liquid or bulk goods in bag items of bag webs. The equipment has a filling station, where the bag items are held open to receive the items, and guiding means or guides, which are arranged to retain and guide the bag web along a transport path through the equipment. During passage, the guiding means or guides force the edges of the bag mouths apart for filling in the filling station and after filling they bring the edges of the bag mouths back together for closing the bags.

SUMMARY

An aspect relates to an alternative to the known technology, which eliminates wastage of material or at least reduces it considerably.

Another aspect of embodiments of the invention is to provide a method, equipment and bag webs with zip closure and to ensure quick and effective filling of zip bags, which eliminates wastage of material or at least reduces it considerably.

A further aspect of embodiments of the invention is to provide compact equipment for filling bags, which contains few moving parts.

A further aspect of embodiments of the invention is to provide a method and compact equipment for filling bags, which is reliable, and which optimizes the filling speed for filling bags in bag webs.

These aspects are achieved with a method, equipment and a bag web according to embodiments of the invention.

The method for packing items, liquid or bulk goods in film bags, which are conveyed in a continuous bag web of bag items through equipment with a filling station, is characterized in that the mouths of the bags are held open for receiving items, after which the bags are closed and are separated from the web. The method is characterized in that the bag web comprises a zip closure, which is applied parallel to the upper edge of the bag web and is continuous for the entire length of the bag web. The zip closure is coupled to the first guiding means or first guide or guide, which are/is arranged to retain and guide the zip closure of the bag web along a first section of a transport path through the equipment. The filling station comprises bag opening means or bag opening, which in connection with the passage of the bag web force the edges of the bag mouth apart for successive opening of the bags in the filling station. The mouths of the bags are brought back together as the bag web is coupled to other guiding means or guide, which are arranged to retain and guide the zip closure of the bag web along another section of the transport path through the equipment. Then closure and sealing of the mouths of the bags are carried out. The bag item, which is present in the filling station, is opened when the first and second parts of the zip closure on the side walls of the bag item are forced apart in the filling station for opening the mouth of the bag.

The embodiments further relate to a bag web for use for carrying out a method as described above and hereunder, or in equipment that is described hereunder. The bag web comprises a continuous row of bag items, which are separated by a number of slits, extending from a bottom edge of the web up to just below a top edge of the bag web. The lateral edges of the bag items are closed with welds at the slits. The bag web comprises an upper peripheral zone above a zip closure and is characterized in that the zip closure is continuous for the entire length of the bag web. The zip closure is applied parallel to the upper edge of the bag web and at a distance from the upper end of the slits. This means that the lateral edges of the bag items are not sealed in the section that extends from the upper edge above the upper peripheral zone and up to the upper end of the slits.

The bag mouth on the bag item with the zip closure is thus opened when the sealed lateral edges of the bag items, i.e. the slits of the lateral edges, are brought against one another in the direction of transport in the filling station. As the zip closure is both flexible and has a certain stiffness relative to the film layer making up the bag item itself, the two parts of the zip closure will bend outwards and away from one another. When the zip closure is opened in the filling station during feed of the bag web this may take place for example by introducing a vertical finger from above and downwards in the bag opening in the front part of the filling station. The side walls of the bag web are not sealed in the uppermost part between two successive bag items. In the lateral edges of the bag web, the finger may open the bag items continuously in the bag webs, when they arrive at the filling station. This can take place without moving parts that travel from above and downwards in the bag opening.

Moreover, there is the advantage that when gripping around the zip closure so as to be able to guide the bag web in the direction of transport, it is no longer necessary to provide the bag web with edge zones with perforations or the like so as to grasp pins or similar gripping means or grip on the guiding means or guide. As a result, the width of the edge zone, i.e. the region above the zip closure on the bag web, may be reduced so as to comprise an edge that is wide enough to comprise a seal and optionally a break line for easy opening of the bag between the zip closure and the seal and/or optional means or an option for hanging up the bag, e.g. in the edge zone above the seal.

According to embodiments of the invention, it is parts of the bag web itself that the guiding means or guide grip round for feeding the bag web in the direction of transport. This means that it is no longer necessary to cut a part of the edge zone away before the filled and sealed bag is sent on to the next step of the process, e.g. prepacking in additional packaging for forwarding to warehouse storage. This gives a considerable reduction in consumption of material.

The form of bag items in the bag web according to embodiments of the invention is not of importance for embodiments of the invention. They may therefore be flat bags, including cone bags, or gusset bags. In addition, the sides of the bag may be folded.

Bags of this kind are generally made from plastic films, where at least sides of films that face one another consist of weldable plastic materials. Multilayer films may also be used.

The bags may optionally be provided with folded bottom pieces for forming stand-up pouches, or the flat sides of the bag may be folded to form a bottom or may be welded together directly in the edge zones along the bottom edge of the bag.

The zip closure in the bag web is typically welded, extruded or glued on the film. The elements of the zip are typically placed parallel to the top edge of the bag, which delimits the opening of the bag, typically at a short distance from the top edge.

The method comprises opening of the bag mouth on the bag in the filling station, briefly stopping or reducing the feed speed in the second guiding means or guide and the bag web in the second part of the transport path in the opposite direction, while the bag web and the first guiding means or guide in the first part of the transport path advance the bag web.

This leads to simplification of the method and leads to fewer moving parts in the equipment, see also the description of the equipment hereunder.

Alternatively, the method comprises opening of the bag mouth on the bag in the filling station by briefly increasing the feed speed in the first guiding means or first guide and maintaining or reducing the feed speed in the second guiding means or second guide.

In another alternative the method comprises opening of the bag mouth on the bag in the filling station by briefly stopping or reducing the feed speed in both the first and the second guiding means or second guide and therefore the bag web in the first and second part of the transport path, as the first part of the transport path is mounted movably in the equipment, e.g. on a movable carriage, and is displaced in the direction of transport for opening the bag in the filling station.

As described below, the first part of the transport path is mounted movably in the equipment and is displaced to and fro in the direction of transport for adjustment to the bag size and/or the width of the opening of the bag. This means moreover that the bag items can be opened in the filling station by using this movable unit during filling and displacing the first part of the transport path in the direction of transport during filling of the bag or at least during introduction of a filling nozzle through the bag opening. This provides an alternative, simple way of opening the bag mouths on the bag in the filling station during feed of the bag webs through the equipment.

After the bag items have been filled with their contents, the bag mouth is sealed in the edge zone above the zip closure and the uppermost part of the lateral edges of the bag items. This may be carried out in one sealing step, which is quick, or as two independent steps. The upper continuous zone of the bag web between two bags is also cut for separating the filled and sealed bags from the bag web.

To ensure that the zone of the lateral edge over the zip closure is also sealed correctly, the zip closure may be crushed in the sealing zone before sealing. This may be effected for example with jaws, which crush the zip closure, or with a unit that strikes against the zip closure in the sealing zone. This crushing of the zip closure may be performed in an independent unit or in direct contact with the sealing unit, e.g. forming an integral part of the sealing unit.

Alternatively, crushing of the zip closure of the bag web may take place in connection with production of the bag web. This means that the crushing unit may be omitted from the equipment, and there will be no need to crush the zip closure in connection with bag filling. This can simplify the equipment so that it becomes cheaper and easier to manufacture. It also helps to increase the filling speed for the filling of bag items.

Cutting-off of the filled bag item from the bag web is carried out in a cutting station, which is an independent unit or alternatively an integrated part of the sealing station. If the bag item is to contain a hole for hanging up the bag item, this can be punched out in the edge zone, above the seal of the bag mouth, in the cutting and/or sealing station. Moreover, an optional break line applied in the region between the seal of the bag mouth and the zip closure, is stamped in the film material, for example in the cutting and/or sealing station.

The embodiments also relate to equipment for packing items, liquid or bulk goods in film bags, which are conveyed in a continuous web of bag items through a filling station, wherein the mouths of the bags are held open for receiving items, the bags then being closed and separated from the web.

The equipment comprises a filling station, where the bag openings are opened and are held open for receiving items, and guiding means or guide, which are arranged to retain and guide the bag web along a transport path through the equipment, wherein the guiding means or guide, in connection with this passage, force the edges of the bag mouth apart for successive opening of the bags in the filling station and then, after the bags have been filled, bring the edges of the bag mouths back together for closing the bags. The equipment according to embodiments of the invention is characterized in that the transport path comprises first and second separately controllable guiding means or separately controllable guide, where the first guiding means or first guiding means is placed before the filling station, and the second guiding means or second guide is placed after the filling station. The first and second guiding means or second guide are arranged to grip around a zip closure in the bag web, which is applied parallel to the upper edge of the bag web and is continuous for the entire length of the bag web, wherein the zip closure may be coupled to the first guiding means or first guide, which is arranged to retain and guide the zip closure of the bag web along a first section of transport path towards the filling station, and coupled to the second guiding means or second guide, which is arranged to retain and guide the zip closure of the bag web along the second part of the transport path after the filling station.

This construction means that it is possible to use a part of the bag web to grasp the transport path during advance of the bag web. This avoids having to provide the bag web with wide edge zones, which will interact with the guiding means or guide and ensure feed in the transport path, as has been employed up to now. Previously these wide edge zones were cut off and constituted wastage of packaging material. By conveying the bag web through the transport path in the equipment, to be retained in the zip closure, it is no longer necessary for the bag web to be produced with wide edge zones with gripping means or grip for interacting with the guiding means or guide. Moreover, a very simple, quick and effective way of opening the bag items at the filling station is obtained, which makes use of the increased flexibility and stiffness of the zip closure relative to the film of which the bag item itself is constituted. This is achieved because it is possible to control the feed speed in the two separate guiding means or separate guides independently of one another. This is achieved by forcing the sides of the bag item apart in the filling station, for example by briefly increasing the feed speed in the first guiding means for first guide, i.e. before the filling station, relative to the feed speed in the second guiding means or second guide, which is mounted after the filling station. As a result, the lateral edges of the bag item are pushed against one another in the filling station, and the flexibility and stiffness of the zip closure mean that the two halves of the zip closure bend outwards and away from one another and bring about automatic opening of the bag mouth in the filling station. Opening of the bag mouth may thus take place without using gripping means or a grip that interact with the edge zone in the bag web to open the bag mouth.

The means for opening the bag items in the filling station comprise a first finger directed vertically downwards, which is mounted on the first part of the feed web, for separating each part of the zip closure of the bag web during passage of the bag web through the filling station, and another finger directed vertically downwards, which is mounted on the second part of the feed web, and together with the first finger, holds the bag item open in the filling station.

During transport through the first part of the feed web, the zip closure will be caught between the gripping means or grip. This may mean that the zip closure is closed when a bag item arrives at the filling station. The halves of the zip closure can therefore be separated at the inlet of the filling station by guiding the sides of the bag web past each side of the aforementioned vertical finger. This ensures that the zip closure is open in the filling station, and that the two halves of the zip closure are able to bend outwards and away from one another, as described above and hereunder. As the lateral edges of the bag items in the bag web are not sealed in the region above the zip closure and for a certain distance below the zip closure, the finger is able to separate the two halves of the zip closure continuously during transport of the bag web in the transport path, also in the region at the lateral edges between two successive bags. The other vertical finger helps to separate the two halves of the zip closure and hold the bag mouth open in the filling station.

Placing the finger or the fingers close to the lateral edge(s) of the bag items ensures that bag opening is larger in the filling station. This helps to make it easier to introduce one or more filling nozzles into the bag opening and ensure quick and effective filling of the bag item in the filling station.

The shape of the vertical finger or fingers may contribute to keeping the two halves of the zip closure apart, e.g. wedge-shaped, oval, round or a similar shape that ensures separation of the two halves and moreover means that the two halves of the zip closure are moved away from one another during passage on each side of the finger or the fingers.

The effect of gravity on the contents, such as bulk goods, produces a downward force, which is normally sufficient to fold out the bottom of stand-up pouches without using further equipment. If necessary, the filling nozzle may simply be made with a long tip, which goes all the way down against the bottom of the stand-up pouch in connection with filling and can thus fold out the bottom of the bag, ensuring correct filling of the bag. Alternatively, it is also possible to fold out the bottom of stand-up pouches by providing at least one of the fingers with a telescopic extension, which can go down into the bag and press against the bottom of the stand-up pouch so that it is unfolded. Alternatively, one or both fingers may contain a telescopic air nozzle, which blows air against the bottom for unfolding before the actual filling of the bag begins.

The guiding means or guide in the first and/or second part of the feed web comprises clamping means or clamp, which are arranged so that they press against each of the outer sides of the bag web in the region around the zip closure for securing and guiding the bag web in the feed web.

This provides effective and reliable positioning and retaining of the bag web in the guiding means or guide. The guiding means or guide comprises for example at least a belt, namely, two belts, such as a toothed belt, a rubber belt with a surface that presses against one or both sides of the zip closure of the bag web and a region above and below the zip closure.

The gripping face of the belt or belts may be provided with a profiled surface, with a recess that extends in the direction of transport until the zip closure itself is applied during feed, which reduces the risk of the gripping means or grip pressing so hard against the zip closure that it is destroyed. Moreover, this means that the bag web cannot fall out of the guiding means or guide of the equipment.

Alternatively, the guiding means may comprise belt, spring or chain drives, on which clamping means are mounted, e.g. in the form of blocks, which function as jaws that are pressed in against one another in the region around the zip closure of the bag web for retaining the bag web in the guiding means or guide in the equipment.

As already stated above, it is preferable for the first part of the feed web to be mounted movably in the equipment for displacement in the direction of transport. This allows the filling station to be adjusted to the size of the bag items and in particular the width of the bag items by displacing the first part of the feed web forwards and/or backwards in the direction of transport. This take places automatically, e.g. by entering the bag size and/or bag width in the control system of the equipment, or alternatively the position of the first part of the transport path may be set manually beforehand for each filling operation.

A spear may be applied, which grips into the continuous open channel that is formed in the bag web under the zip closure and above the upper end of the seal in the lateral edges of the bag items. This spear is applied under the first guiding means first guide and guides the bag web in the direction of transport and correctly into the first guiding means or first guide.

The equipment according to embodiments of the invention comprises control means or control, which are arranged for briefly stopping the second guiding means or second guide and the bag web in the second part of the transport path, while the first guiding means or first guide in the first part of the transport path continuously feeds the bag web forwards towards the filling station, briefly increasing the feed speed in the first guiding means and maintaining or reducing the feed speed in the second guiding means or second guide, or briefly stopping or lowering the feed speed for both the first and the second guiding means or second guide and therefore the bag web in the first and second part of the transport path and displacing the first movable part of the transport path in the direction of transport, for opening the bag item that is located in the filling station.

This provides compact equipment that helps to make it possible to use bag webs without special gripping means or special grip in the edge zones. Moreover, this gives fully automatic, quick and effective opening of the bags in the filling station, which helps to increase the filling speed.

When the bag "wriggles" through the equipment in the manner described above, simple and effective control of the transport of the bag web through the equipment is obtained. This may also help to increase the filling speed, as there are fewer stops in the transport of the bag web through the equipment.

As mentioned above in connection with the description of the method according to embodiments of the invention, the equipment comprises, after the filling station, one or more welding stations for sealing the mouth of the bag and/or the lateral edge in the uppermost continuous zone of the lateral edges of the bag items, and a cutting station for separating the filled and sealed bag items from the bag web.

A conveyor may be mounted under the transport path over the whole or part of the length of the equipment, including in particular under and after the filling station. The conveyor supports the bag items during and after filling and ensures correct filling subsequently and correct sealing of the bag items.

BRIEF DESCRIPTION

Some of the embodiments will be described in detail, with references to the following Figures, wherein like designations denote like members, wherein.

DETAILED DESCRIPTION

Figure 1:
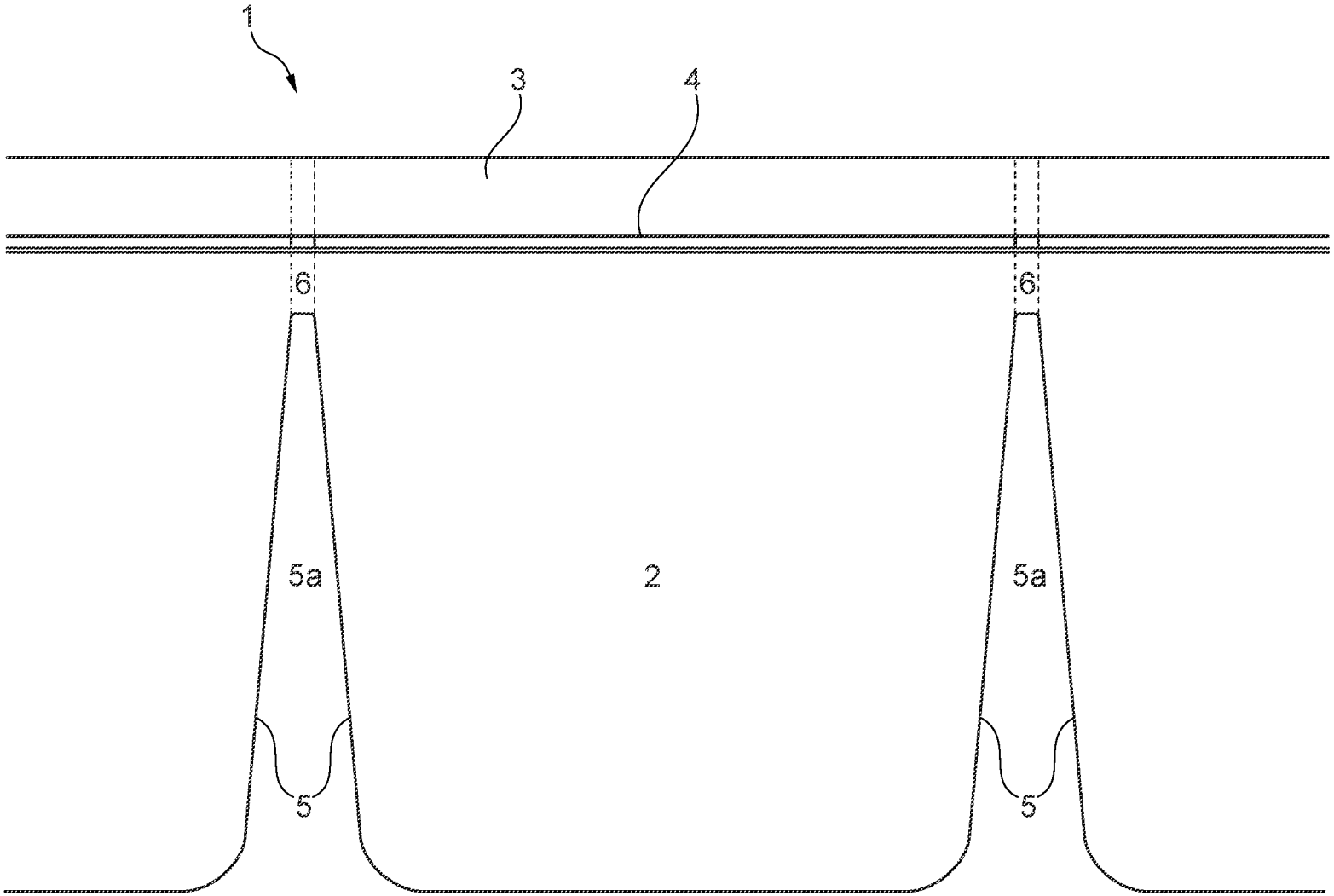
FIG. 1 shows a bag web according to embodiments of the invention.

FIG. 1 shows a bag web 1 according to embodiments of the invention, which comprises a row of bag items 2. A zip closure 4 is applied between the upper peripheral zone 3 and the bag items. The bag items 2 are connected in the region of the lateral edges 5 of the bag items 2 in the upper peripheral zone 3 and thus form a bag web 1.

Below the zip closure 4, in the region by the sealed lateral edges 5 of the bag items 2, there is a zone 6 that is not sealed. The sides of the bag web are made of film, also including laminates, and laminates that comprise layers of paper or metal, the layer or layers of film that face one another in the bag items 2 being weldable to form the lateral edges 5 of the bag items 2.

The bag items 2 of the bag web 1 are separated by a number of slits, extending from a bottom edge of the web up to just below a top edge of the bag web. The lateral edges of the bag items 5 are closed with welds at the slits 5*a*. The bag web comprises an upper peripheral zone above a zip closure, the zip closure being continuous for the entire length of the bag web. The zip closure is applied parallel to the upper edge of the bag web and at a distance from the upper end of the slits 5*a*. This means that the lateral edges of the bag items 5 are not sealed in the section that extends from the upper edge above the upper peripheral zone 3 and up to the upper end of the slits 5*a*.

The shape of the bag items 2 is shown in FIG. 1 and other figures as flat bags, but may also have other configurations, as already described above.

Figure 2:
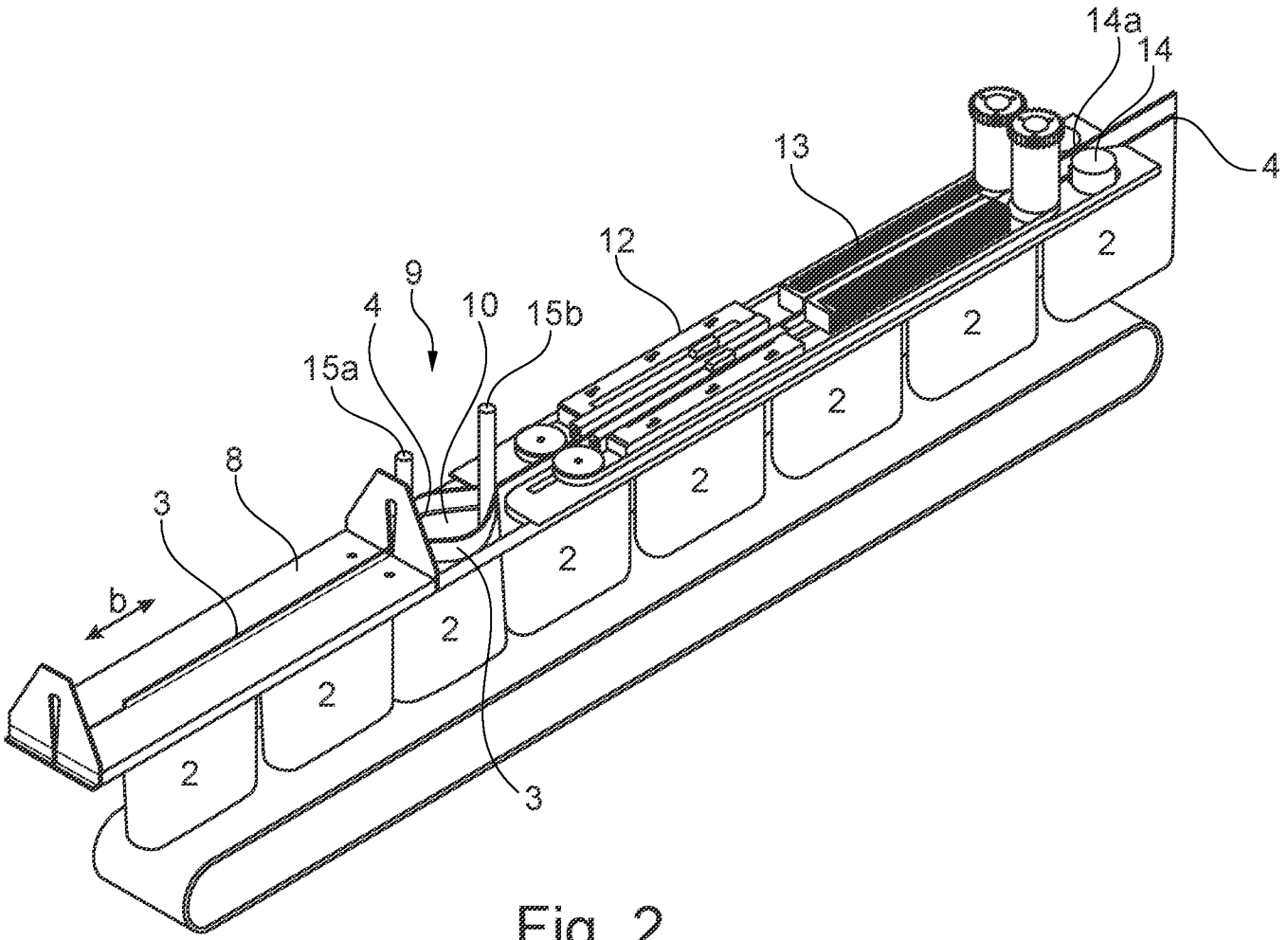
FIG. 2 shows a perspective view of the equipment according to embodiments of the invention.
Figure 3:
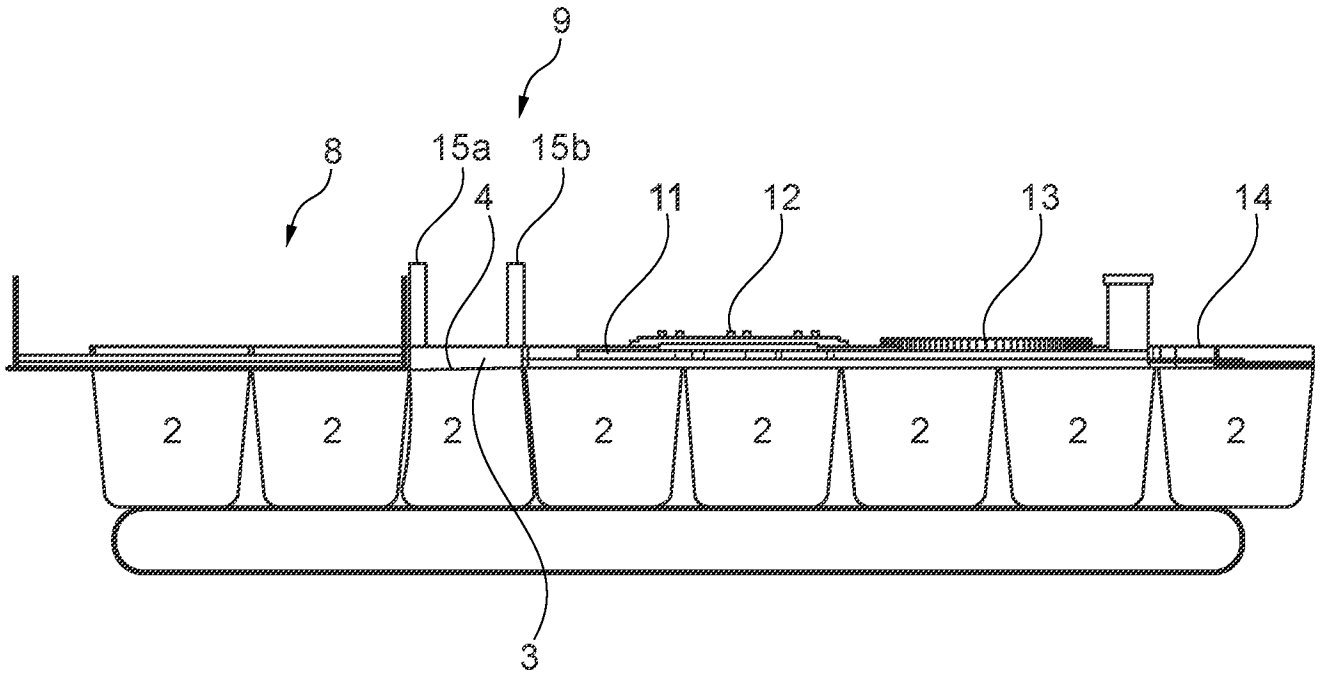
FIG. 3 shows a side view of the equipment according to embodiments of the invention.
Figure 4:
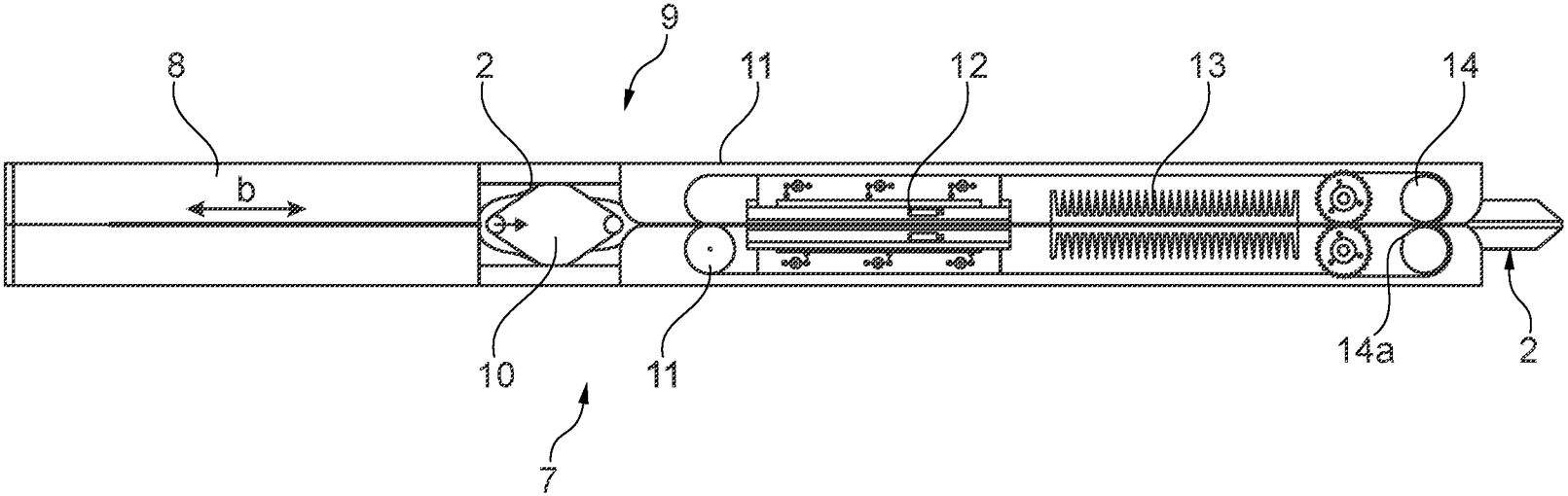
FIG. 4 shows a top view of the equipment according to embodiments of the invention.

FIGS. 2-4 show a first possible embodiment of equipment for packing bulk goods or liquid items in the bag items 2, in perspective view, side view and top view, respectively.

The bag web 1 is conveyed through the filling equipment 7 along a transport path. The equipment 7 comprises a filling station 9, where the bag mouth 10 is held open during filling for receiving bulk goods, liquids or items. After filling of the bags 2, the bag mouth 10 is closed by sealing the bag mouth in the upper peripheral zone 3 of the bag 2. This takes place in a sealing unit 12, which is installed after the filling station 9 in the direction of the transport path. A cooling unit 13 is preferably installed after the sealing unit 12.

After sealing of the bag mouth 10 in the filled bag 2, optionally crushing of the zip closure 4 is performed in a crushing unit 14. Crushing of the zip closure 4 takes place in the region above the lateral edges of the bag items 5, see the dashed lines in FIG. 1, to ensure that the subsequent sealing of the uppermost part of the lateral edges 5 of the bags, i.e. in the region marked with dashed lines in FIG. 1, is tight and effective. Crushing of the zip closure takes place, in the variant of the equipment 7 shown, with jaws 14*a*, which clamp at a predetermined distance against the zip closure 4 in the region above the lateral edge 5, where the subsequent sealing of the upper part of the lateral edge 5 of the bag will take place. The jaws 14*a* may be formed as vertical projections on a rotating unit, which clamps the upper peripheral zone of the bag item above the seal of the lateral edge 5. Alternatively, in a variant of the equipment that is not shown, jaws 14*a* may be installed on each side of the bag item, which clamp onto the zip closure with a linear movement perpendicular to the bag items.

This crushing of the zip closure 4 may be performed in an independent unit, as shown in FIGS. 2-4. Alternatively, crushing of the zip closure 4 may take place in or in direct contact with the sealing unit 12, e.g. constituting an integral part of the sealing unit 12 or a subsequent (not shown) unit for sealing the upper, non-sealed part of the lateral edges of the bag items 5.

After sealing of the uppermost part of the lateral edges 5 of the bag items 2, the filled bag is separated from the bag web in a cutting unit (not shown).

It is not necessary to cut material from the edge zone 3 of the bag item 2, because with embodiments of the invention it has become superfluous to design the bag webs 1 with wide edge zones 3 with gripping means or grip that interact with guiding means or guide for guiding the bag web 1 through the equipment 7 for filling the bags 2.

The welding station 13 or the subsequent cutting unit may optionally also contain a unit that stamps a break line in the peripheral zone 3 of the bag item. This break line runs between the sealing line for sealing the bag mouth and above the zip closure 4.

Feed of the bag web 1 through the equipment 7 takes place by means of the zip closure 4. The zip closure 4 is coupled to the first guiding means or first guide 8, which is arranged to retain and guide the zip closure 4 of the bag web 1 along a first section of a transport path through the equipment 7 and towards the filling station 9.

The first part of the transport path with the first guiding means or first guide 8 is mounted movably in the equipment 7 and is displaced to and fro in the direction of transport, as shown by arrow b for adjustment to the bag size and/or the width of the opening of the bag. This takes place automatically, e.g. by entering the bag size and/or bag width in the control system of the equipment, or alternatively the position of the first part of the transport path, which is a movable carriage mounted in the equipment, can be set manually beforehand for each filling. Manual setting means or setting may comprise e.g. fastening means or fastening, such as one or more bolts with the associated nuts, e.g. wing nuts, which are fitted through a slit (parallel to the direction of transport) in the carriage and a hole drilled in the frame of the equipment 7.

Figure 7:
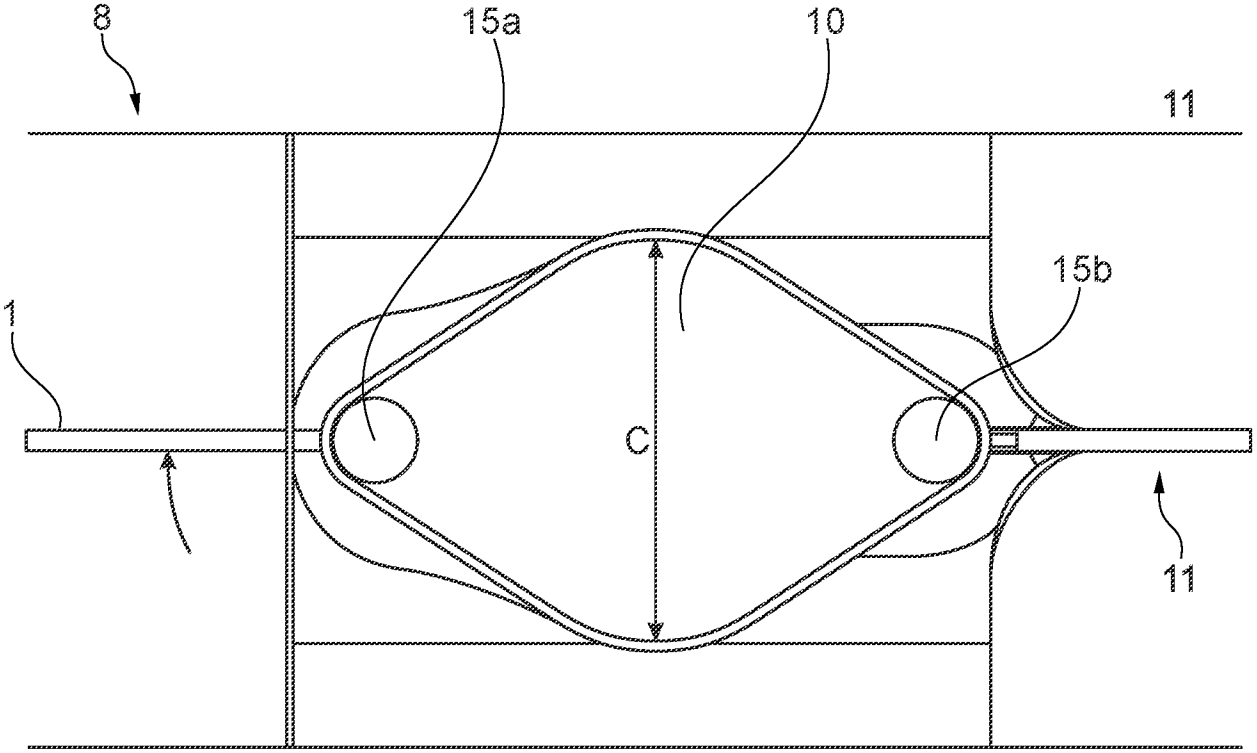
FIG. 7 shows an opened bag item in the filling station.
Figure 8:
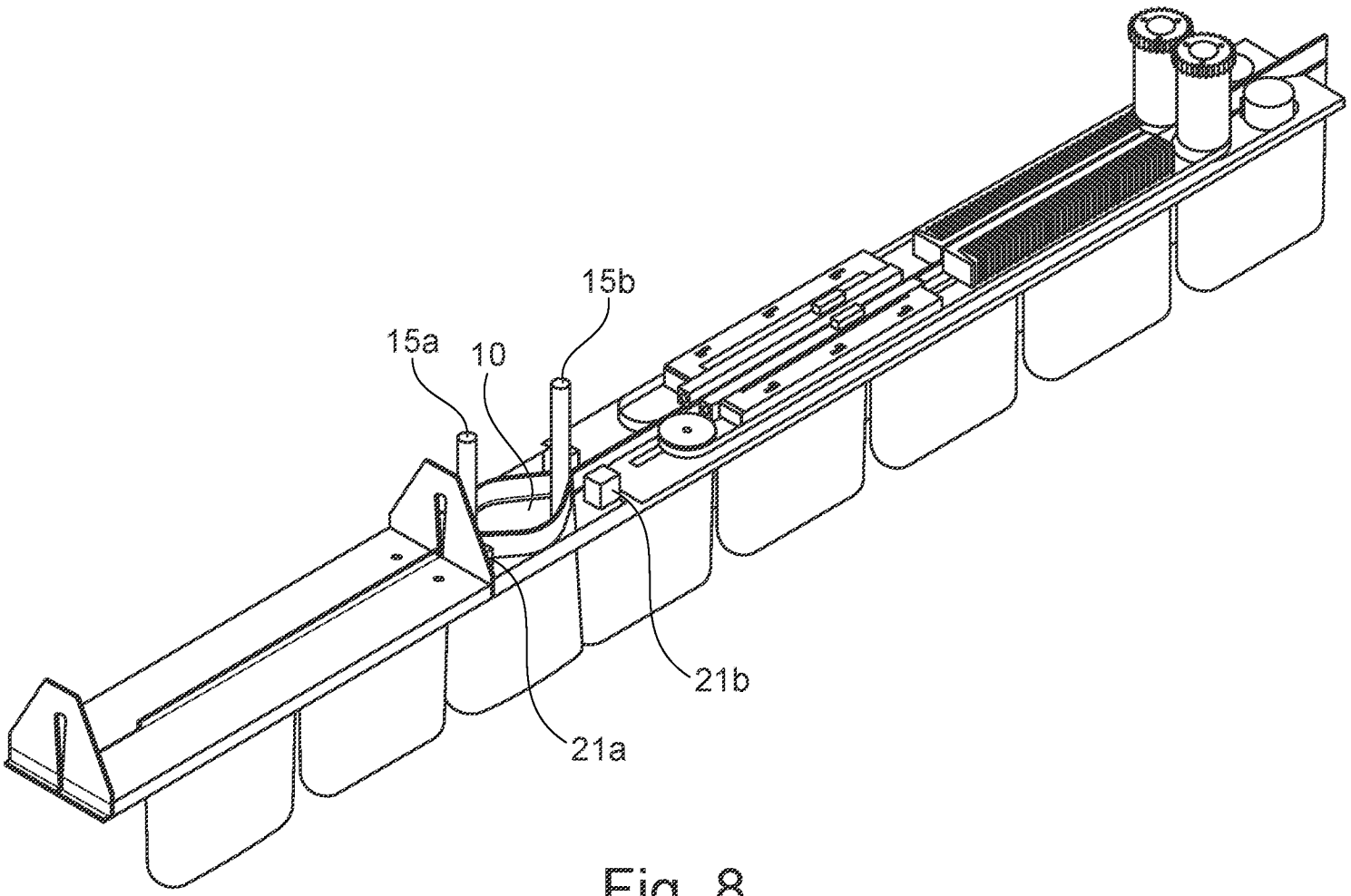
FIG. 8 shows a perspective view of a variant of the equipment according to embodiments of the invention.
Figure 9:
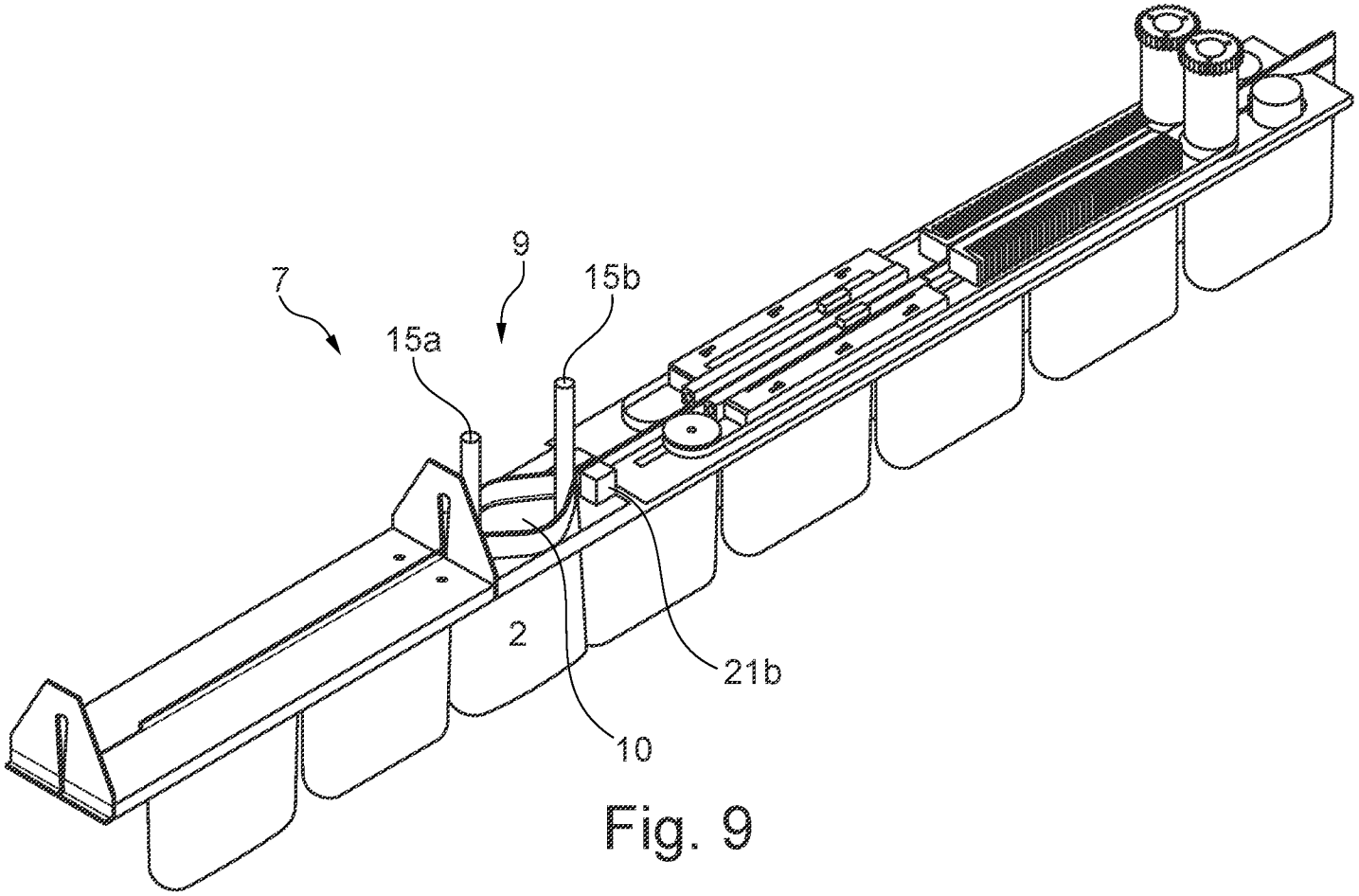
FIG. 9 shows a perspective view of a variant of the equipment according to embodiments of the invention.
Figure 10:
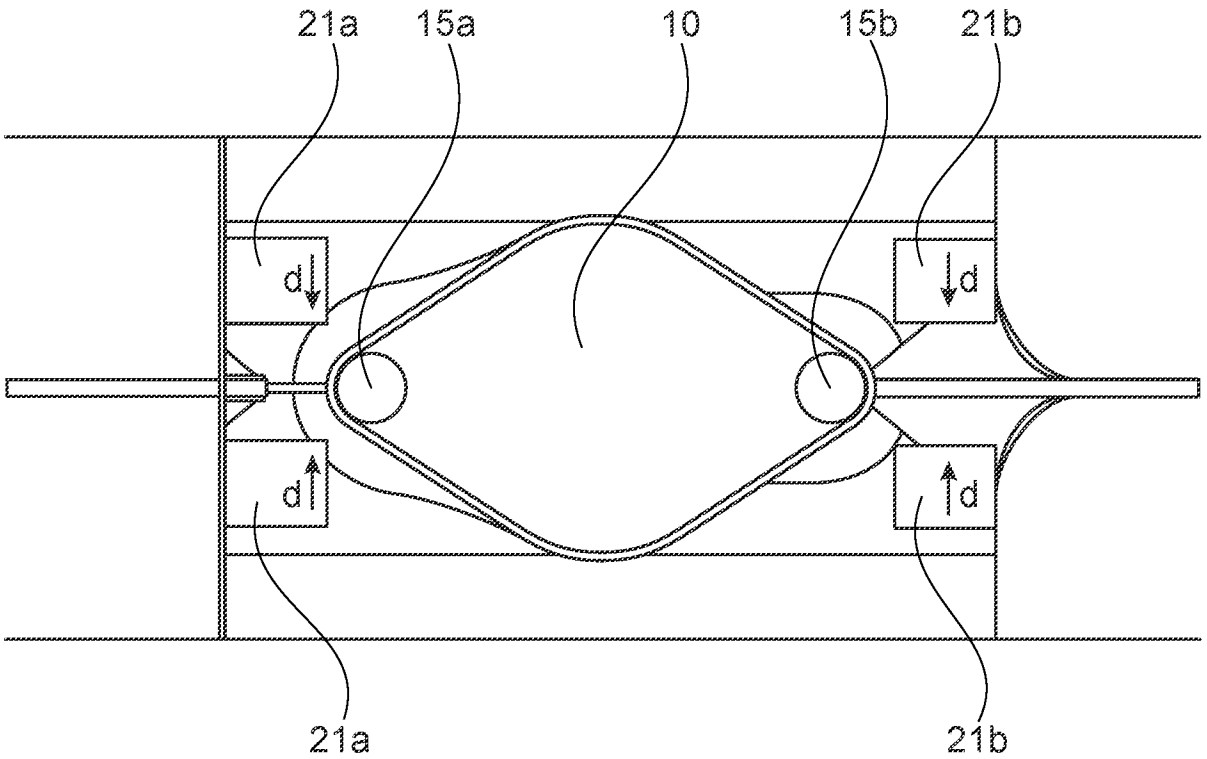
FIG. 10 shows a top view of an opened bag item in a filling station as shown in FIG. 8-9.
Figure 11:
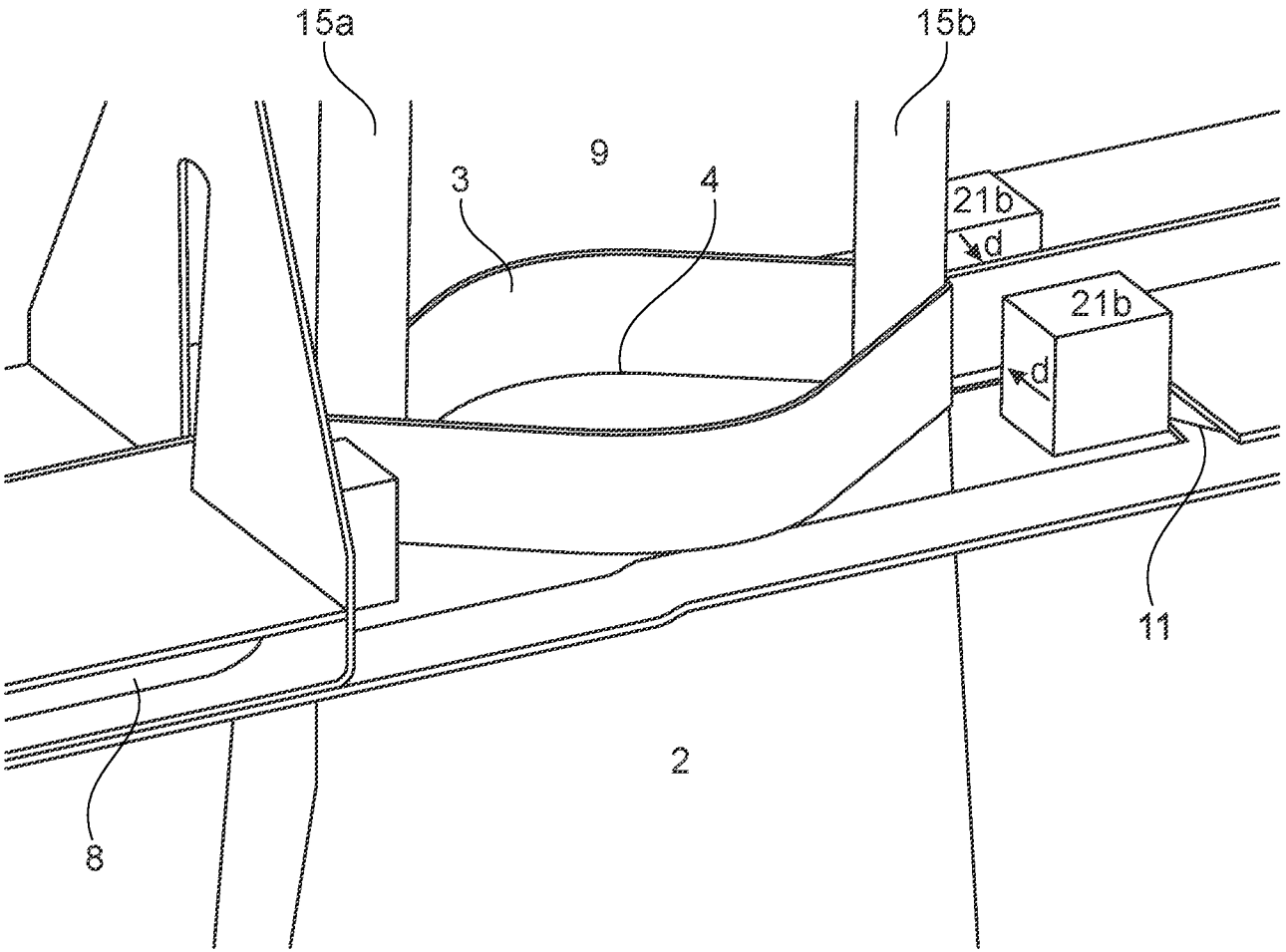
FIG. 11 shows a perspective view of an opened bag item in a filling station as shown in FIG. 8-9.
Figure 12:
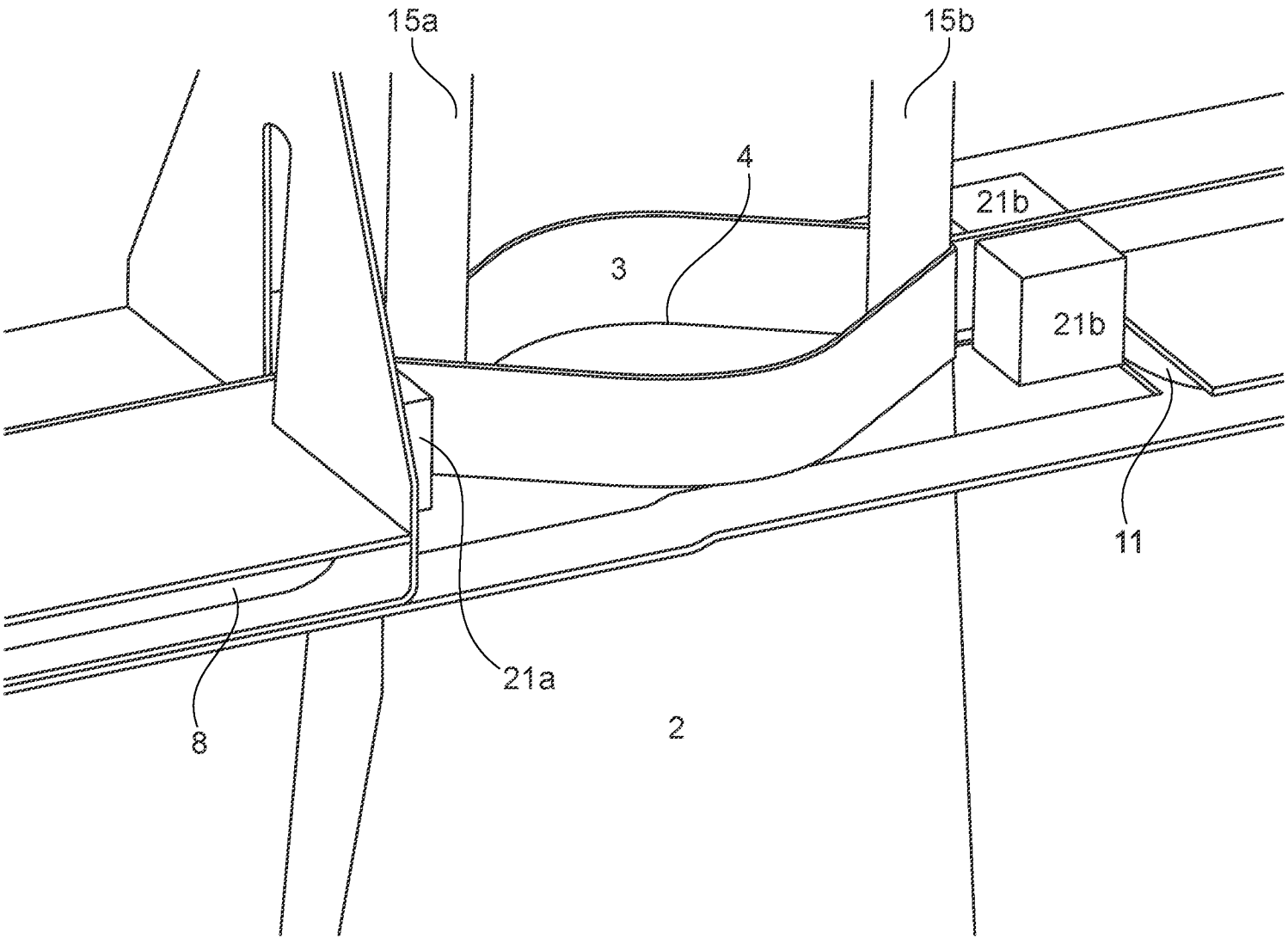
FIG. 12 shows a perspective view of an opened bag item in a filling station as shown in FIG. 8-9.

During transport through the first guiding means or guide 8 and the second guiding means or guide 11 it is preferable for the zip closure 4 to be closed during feed, as this reduces the risk of the zip closure being destroyed when it is clamped between the gripping means or grip of the guiding means or guide 8, 11. This will often mean that the zip closure is already closed when the bag web 1 is fed into the equipment 7 or at least when a bag item 2 arrives at the filling station 9 after contact with the first guiding means or guide 8. The halves of the zip closure 4 will therefore be separated at the inlet of the filling station 9. This takes place by feeding each of the sides of the bag web 1 past bag opening means or opening 15, which in connection with the passage of the bag web force the edges of the bag mouth apart, as shown by arrow c in FIG. 7 for successive opening of the bags in the filling station 9.

The mouths of the bags are brought back together by coupling the bag web 1 to the other guiding means or guide 11, which are arranged to retain and guide the zip closure of the bag web 4 along another section of the transport path through the equipment 7.

The bag item that is located in the filling station 9 is opened in that the first and second parts of the zip closure 4 on the side walls of the bag item are forced apart in the filling station 9 to open the mouth of the bag 10.

The bag mouth on the bag item 2 in the filling station 9 with the zip closure 4 is thus opened in that the lateral edges 5 of the bag items 2, i.e. the lateral edges 5 and slits 5*a*, are brought against one another in the direction of transport in the filling station 9. As the zip closure 4 is both flexible and has a certain stiffness relative to the film layer, which constitutes the actual bag item 2, the two halves of the zip closure 4 will bend outwards and away from one another.

The zip closure 4 is opened in the filling station 9 during advance of the bag web 1 into the filling station 9. This takes place in that a first vertical finger 15*a* is introduced from above and downwards in the bag opening 10, i.e. in the front part of the filling station 9. The first vertical finger 15*a* is mounted on the first part of the transport path, which comprises the first guiding means or guide 8.

As mentioned, the lateral edges 5 of the bag items 2 are not sealed in the uppermost part 6 between two successive bag items 2 in the bag web 1. Therefore, the first vertical finger 15*a* can open the zip closure 4 of the bag items in the bag webs 1 continuously, when they arrive at the filling station 9. This can take place without moving parts.

After the filling station 9, other guiding means or guide 11 are installed, which again grip the continuous zip closure 4 of the bag web in the same way as the first guiding means or guide 8.

To help to hold the bag mouth 10 open in the filling station 9 and to ensure that the two halves of the zip closure 4 are brought back together correctly after the filling station 9 another vertical finger 15*b* is provided on the second part of the transport path, which comprises the second guiding means or guide 11.

The bag mouth 10 on the bag 2 in the filling station 9 is opened by briefly stopping or reducing the feed speed in the second guiding means or guide and the bag web in the second part of the transport path in the opposite direction, while the bag web and the first guiding means or first guide in the first part of the transport path feeds the bag web continuously through the filling station.

Alternatively, the bag mouth on the bag in the filling station is opened by briefly stopping or reducing the feed speed in both the first 8 and the second 9 guiding means or guide and therefore the bag web 1 in the first and second part of the transport path, and the first part of the transport path is mounted movably in the equipment 7 and is displaced in the direction of transport, as shown by arrow "a" for opening the bag in the filling station 9.

Furthermore, this also makes it possible for the bag items to be opened in the filling station 9 by using this movable unit 8 during filling, and displacing the first part of the transport path in the direction of transport during filling of the bag, or at least during introduction of a filling nozzle through the bag opening 10.

Cutting-off of the filled bag item 2 from the bag web is carried out in a cutting station (not shown), which is an independent unit or alternatively an integrated part of the sealing station 12. If the bag item is to contain a hole (not shown) for hanging up the bag item, this can be punched out in the edge zone, above the seal of the bag mouth, e.g. either in the cutting and/or the sealing station 12. Moreover, an optional break line, which is provided in the region between the seal of the bag mouth and the zip closure, is stamped in the film material, e.g. in the cutting and/or sealing station 12.

If the bag web 1 comprises stand-up pouches with a folded bottom, it is possible to fold out the bottom of the stand-up pouches 2 by providing at least one of the vertical fingers 15*a*, 15*b* with a telescopic extension, which can go down into the bag and press against the bottom of the stand-up pouch so that it is unfolded. Alternatively, one or both of the vertical fingers 15*a*, 15*b* may contain a downward-directed air nozzle, which is optionally fitted telescopically in at least one of the vertical fingers 15*a*, 15*b*. The air nozzle can thus blow compressed air against the bottom for unfolding the standing bottom, before the actual filling of the bag begins.

Figure 5:
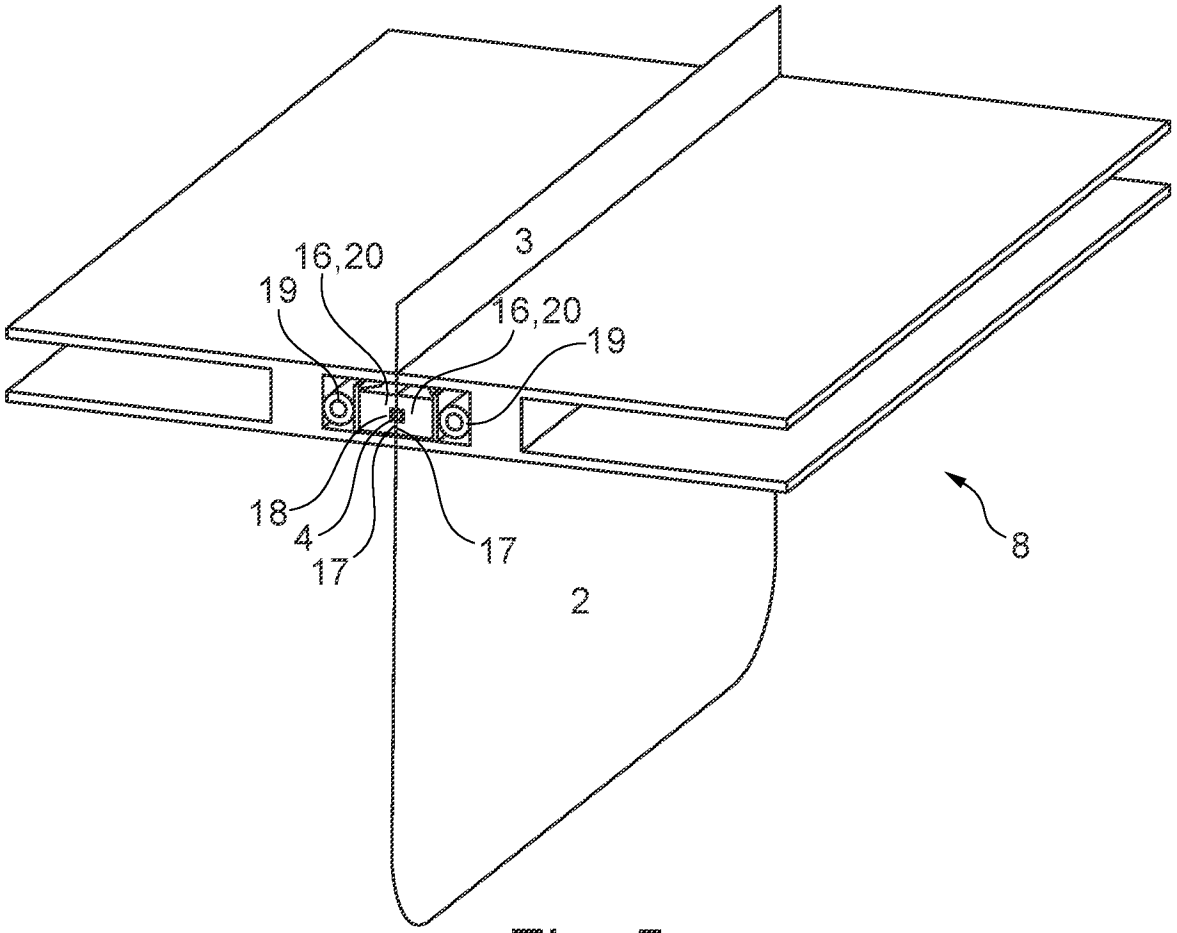
FIG. 5 shows cross-sectional and perspective views of a variant of guiding means or guides in the first part of the feed web in the filling station.
Figure 6:
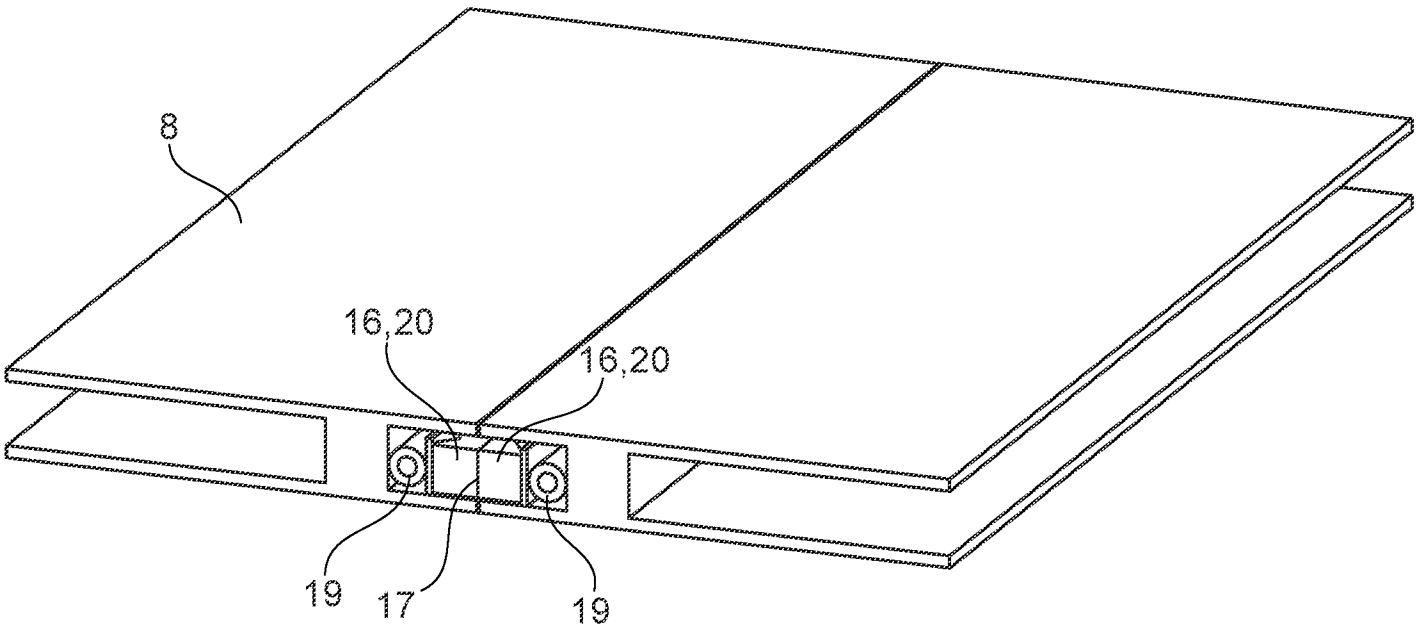
FIG. 6 shows cross-sectional and perspective views of a variant of guiding means or guides in the first part of the feed web in the filling station.

The first guiding means or guide 8 are shown in FIGS. 5-6. The guiding means or guide 8 in the first and/or second part of the feed web comprise clamping means or clamp, which are arranged to bear against each of the outer sides of the bag web in the region around the zip closure for securing and guiding the bag web in the feed web.

The guiding means of guide 8 comprise at least one belt 16, two belts 16, with a gripping surface 17, which bears against at least one or both sides of the zip closure 4 of the bag web 1 and a region above and below the zip closure 4.

The belts 16 are endless belts with driving means or drive that are not shown, which are driven synchronously by one or more motors (not shown), stepping motors or servomotors. By using stepping motors or servomotors the movement of the bag web is precise and can be controlled, so that it is accurately known where the bag items of the bag web are located relative to the individual stations, e.g. the filling, welding, crushing and/or cutting station in the equipment 7.

The gripping surface 17 on the belt 16 or the belts 16 may be provided with a profiled surface with a track 18, which extends in the direction of transport for placement of the zip closure 4 itself during feed.

Alternatively, the guiding means or guide 8 may comprise a belt, spring or chain drive 19, on which clamping means or clamp 20 are mounted, e.g. in the form of blocks, which function as jaws 20, which are pressed in against one another around the bag web 2 in the region around the zip closure of the bag web 4 for retaining the bag web in the guiding means or guide 8, 11 in the equipment 7.

A spear (not shown) may optionally be provided, which grips into the continuous open channel 6 that is formed in the bag web under the zip closure 4 and above the upper end of the seal in the lateral edges of the bag items 5. This spear is provided under the first guiding means or guide and guides the bag web in the direction of transport and correctly into the first guiding means.

The second guiding means 11 in the second part of the feed web after the filling station corresponds to the first guiding means or guide 8. The second guiding means or guide 11 is not movable in the direction of transport. The second guiding means or second guide 11 comprises the same clamping means or clamp, which are arranged to bear against each of the outer sides of the bag web in the region around the zip closure for securing and guiding the bag web in the feed web, as described for the first guiding means 8. Moreover, the driving means for the second guiding means or guide 11 is also identical to that described above for the first guiding means or guide 8.

To obtain fully automatic, quick and effective opening of the bags in the filling station and to increase the filling speed, the equipment according to embodiments of the invention comprises control means or control (not shown in the figures), which are arranged for briefly stopping the second guiding means or guide 11 and the bag web 1 in the second part of the transport path, while the first guiding means or guide 8 in the first part of the transport path continuously feeds the bag web forwards towards the filling station 9, or briefly stopping or lowering the feed speed for both the first 8 and the second guiding means or second guide 11 and therefore the bag web 1 in the first and second parts of the transport path and displace the first movable part 8 of the transport path in the direction of transport, for opening the bag item that is located in the filling station.

FIGS. 8-12 show a variant of the equipment 7 according to embodiments of the invention. The elements in this variant are essentially as described above, this variant differing in that it comprises one or two sets of retaining jaws 21, which clamp round the peripheral zone 3 of the bag web and the zip closure 4, as illustrated by the arrows d in FIGS. 10-12, on leaving the filling station 9 and optionally also at the inlet of the filling station 9 in connection with opening of the bag mouth 10.

The retaining jaws 21*b* at the outlet of the filling station 9 may optionally completely replace the second vertical finger 15*b*.

The retaining jaws 21*a* at the inlet of the filling station may be omitted. A conveyor 22 may be mounted under the transport path in the whole or parts of the length of the equipment 7, including in particular under and after the filling station 9. This is illustrated in FIGS. 2-3, where a conveyor 22 is provided under the transport path over the whole length of the equipment. The conveyor 22 may of course also be added to one of the other equipments 7 mentioned above and/or the variants that are shown in the other figures.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

REFERENCE SYMBOLS 1. bag web
2. bag item
3. upper peripheral zone
4. zip closure
5. lateral edges of the bag item
   a. slits
6. non-sealed region under the zip closure
7. equipment for filling bag items
8. first guiding means
9. filling station
10. bag opening
11. second guiding means
12. welding station
13. cooling unit
14. crushing unit
   a. Jaws
15. bag opening means; vertical bag openers
   a. First vertical finger
   b. Second vertical finger
16. belt
17. gripping surface
18. track in gripping surface
19. belt, spring or chain drive
20. clamping means/jaws on guiding means
21. retaining jaws
22. conveyor belt

The invention claimed is:

1. A method for packing items, liquid or bulk goods in bag items of a bag web, the method comprising steps of:

providing the bag web, wherein the bag web comprises a zip closure, which is applied parallel to the upper edge of the bag web and is continuous for the entire length of the bag web;

providing a transport path of the bag web, wherein the transport path is defined by a filling station, a first guide, and a second guide, wherein the first guide and second guide are separate from each other, wherein the first guide and the second guide are positioned on opposite sides of the filling station along the transport path, wherein the first guide is arranged to retain and guide the bag web to the filling station and the second guide is arranged to retain and guide the bag web from the filling station, wherein the second guide is arranged to grip around and clamp the zip closure along the bag web, and wherein the second guide comprises a belt and a gripping surface and/or a belt, spring, or chain drive and a clamp, wherein the filling station comprises a first finger positioned near the first guide and a second finger positioned at the second guide, wherein the first finger and second finger are positioned on the transport path and the first finger and second finger are perpendicular to the transport path, and wherein the first finger opens the bags continuously by separating parts of the zip closure of the bag web during passage of the bag web through the filling station as an uppermost part of side walls of the bag web are not sealed between two successive bag items, thereby preventing collapse during filling;

forcing the bag items open by briefly stopping the second guide and the bag web, while the first guide continuously feed the bag web forwards towards the filling station, and/or briefly increasing the feed speed in the first guide and maintaining or reducing the feed speed in the second guide.

2. The method according to claim 1, wherein a bag mouth and the uppermost part of the lateral edge on the bag items are sealed, and in that the upper continuous zone of the bag web between two bags is cut for separating the filled and sealed bags from the bag web.

3. The bag web for use in carrying out a method according to claim 1, the bag web comprising a continuous row of bag items, which are separated by a number of slits, extending from a bottom edge of the web up to just below a top edge of the bag web, the lateral edges of the bag items being closed with welds at the slits, wherein the bag web comprises an upper peripheral zone above a zip closure, wherein the zip closure is continuous over the entire length of the bag web, and wherein the zip closure is applied parallel to the upper edge of the bag web and at a distance from the upper end of the slits, so that the lateral edges of the bag items are not sealed in the section that extends from the upper edge above the upper peripheral zone and up to the upper end of the slits.

4. The bag web according to claim 3, wherein the bag items are flat bags or gusset bags.

5. Equipment for packing items, liquid or bulk goods in bag items of a bag web comprising a zip closure continuous for the entire length of the bag web, wherein the equipment comprises:

a filling station, where the zip closure of the bag items is forced open and the bag items receive the items, liquid, or bulk goods, a first guide and a second guide, wherein the first guide and second guide are separate from each other, wherein the first guide, the second guide, and the filling station define a transport path of the continuous bag web of bag items, wherein the first guide and the second guide are positioned on opposite sides of the filling station along the transport path, wherein the first guide is arranged to retain and guide the bag web through the equipment to the filling station and the second guide is arranged to retain and guide the bag web through the equipment from the filling station, and the second guide is arranged to grip around and clamp the zip closure along the bag web, and wherein the second guide comprises a belt and a gripping surface and/or a belt, spring, or chain drive and a clamp;

wherein the filling station comprises a first finger positioned near the first guide and a second finger positioned at the second guide, wherein the first finger and second finger are positioned on the transport path and the first finger and second finger are perpendicular to the transport path, wherein the first finger opens the bags continuously by separating parts of the zip closure of the bag web during passage of the bag web through the filling station as an uppermost part of side walls of the bag web are not sealed between two successive bag items, thereby preventing collapse during filling, and a controller adapted for forcing the bag items open by briefly stopping the second guide and the bag web, while the first guide continuously feed the bag web forwards towards the filling station, and/or briefly increasing the feed speed in the first guide and maintaining or reducing the feed speed in the second guide.

6. The equipment according to claim 5, wherein the first guide and/or the second guide comprises a clamp arranged to bear against each of the outer sides of the bag web in the region around the zip closure for securing and guiding the bag web.

7. The equipment according to claim 5, wherein the equipment after the filling station comprises one or more welding stations for sealing the mouth of the bag and/or the lateral edge in an uppermost continuous region of the lateral edges of the bag items and a cutting station for separating the filled and sealed bag items from the bag web.

8. The bag web for use in the equipment according to claim 5, the bag web comprising: a continuous row of bag items, which are separated by a number of slits, extending from a bottom edge of the web up to just below a top edge of the bag web, lateral edges of the bag items being closed with welds at the slits, wherein the bag web comprises the zip closure continuous over the entire length of the bag web, wherein the zip closure divides the bag web into an upper peripheral zone of the bag items, and wherein the zip closure is applied parallel to the upper edge of the bag web and at a distance from the upper end of the slits, so that the lateral edges of the bag items are not sealed in the section that extends from the upper end of the slits and up to the upper edge above the upper peripheral zone.

9. The bag web according to claim 8, wherein the bag items are flat bags or gusset bags.

* * * * *